US005085332A

United States Patent [19]

Gettig et al.

[11] Patent Number: 5,085,332

[45] Date of Patent: Feb. 4, 1992

[54] CLOSURE ASSEMBLY

[75] Inventors: William A. Gettig; Larry E. Shook, both of Millheim, Pa.

[73] Assignee: Gettig Technologies, Inc., Spring Mills, Pa.

[21] Appl. No.: 683,814

[22] Filed: Apr. 11, 1991

[51] Int. Cl.[5] ..... B65D 41/62

[52] U.S. Cl. ..... 215/249; 215/274; 215/277

[58] Field of Search ..... 215/249, 251, 253, 274, 215/277

[56] References Cited

U.S. PATENT DOCUMENTS

| | | | |
|---|---|---|---|
| 3,838,785 | 10/1974 | Lancesseur | 215/251 |
| 3,871,544 | 3/1975 | Peyser | 215/225 |
| 3,893,582 | 7/1975 | Kowalik | 215/221 |
| 3,905,502 | 9/1975 | Wassilieff | 215/250 |
| 4,180,173 | 12/1979 | Diaz | 215/6 |
| 4,211,333 | 7/1980 | Villarejos | 215/249 |
| 4,863,049 | 9/1989 | Suzuki et al. | 215/249 |

*Primary Examiner*—Stephen Marcus
*Assistant Examiner*—Nova Stucker
*Attorney, Agent, or Firm*—Richard C. Litman

[57] ABSTRACT

A closure for a vial or the like includes a cap clampingly engaging the rim of the vial with a resilient stopper therebetween. During the assembly of the closure, an initially one-piece cap device having an uppermost outer sleeve affixed to an integral cap provided with an outwardly flared skirt, is pressed downwardly toward the stopper disposed atop the vial rim. Continued pressure fractures the sleeve from the cap and urges the sleeve downwardly to bias the resilient skirt inwardly, causing lips thereon into a captive position beneath the vial rim. Continued downward movement of the sleeve results in a locking ring on the interior of the sleeve becoming snap-fitted within a recess in the cap skirt. An aseptic condition of the vial contents is maintained as the stopper remains under vertical compression by the top wall of the cap and in view of an annular ring on the cap top wall which is urged into a circular slot provided in the rim of the stopper, overlying the vial rim. Access to the vial contents through the stopper septum is accomplished by breaking away a frangibly attached top post on the cap.

11 Claims, 1 Drawing Sheet

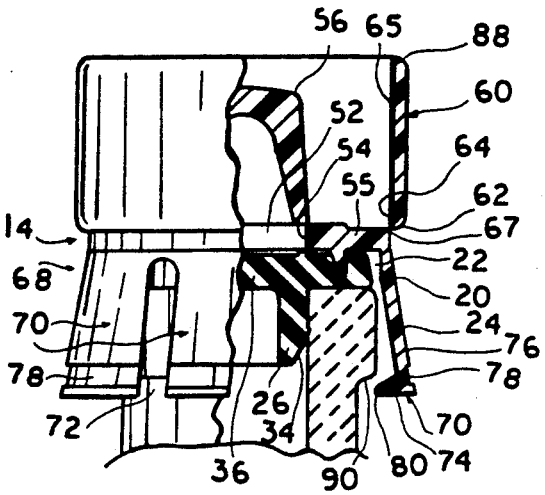
Fig 2
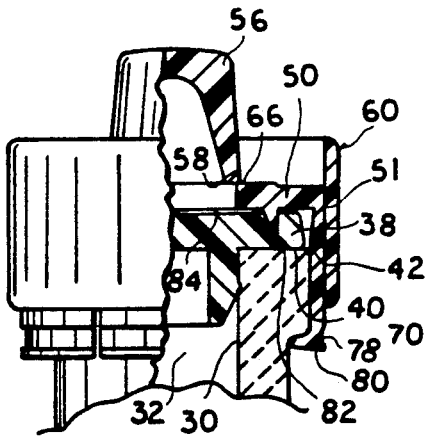
Fig 3
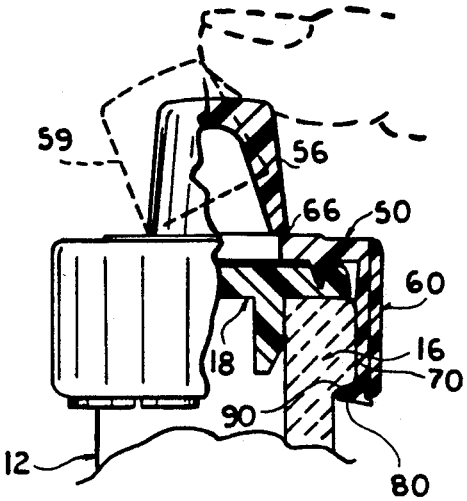
Fig 4
Fig 1
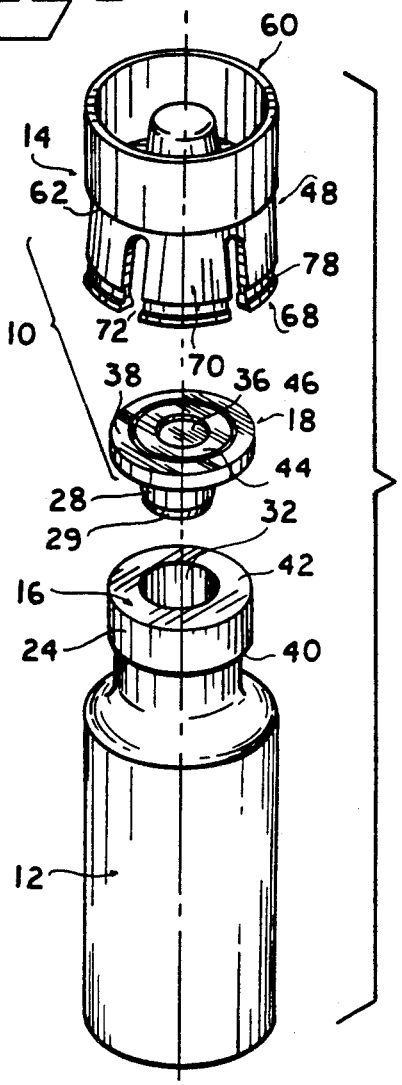

CLOSURE ASSEMBLY

FIELD OF THE INVENTION

This invention relates generally to caps for receptacles and more particularly, to an improved cap and stopper for application to a vial or the like.

BACKGROUND OF THE INVENTION

In the medical field, closures for receptacles such as medicament vials must necessarily meet certain strict and reliable criteria. The purity and sterility of the contents of a medicine vial can only be maintained with a closure device that insures a positive seal against the ingress or egress of air or fluids. Likewise, the components of the closure must be capable of providing an aseptic environment with respect to those components which become exposed when the closure assembly is manipulated immediately prior to use. This use usually comprises the insertion of a syringe needle through a septum or stopper, as employed to withdraw a measured amount of the medicament, prior to administering a dosage to a patient.

The need exists for a readily installable closure assembly wherein an improved unitary cap device cooperates with a stopper member to provide a positive interlock therebetween and form an isolated area within the center of the stopper, while a skirt on the cap device is displaced inwardly beneath a rim formation on the vial to retain the components in the assembled condition. By forming the unitary cap device of a molded plastics composition, and which includes a sliding lock sleeve to achieve the final assembly of the closure, the need for a crimping apparatus is avoided and a more reliable, consistent attachment is obtained, compared to those closures utilizing aluminum caps.

DESCRIPTION OF THE RELATED ART

Vial closures comprising a resilient stopper retained atop a receptacle opening by means of a band member are well known as exemplified by U.S. Pat. No. 4,205,754 issued to Nielsen et al. This patent discloses a metal band member, the top and bottom of which are respectively crimped about the receptacle bead and the stopper. With this arrangement, a separate top cap device is required, along with formations to retain the cap in place until access to the vial is desired. The use of a frangible post element on a container closure, the severance of which provides access to a captive stopper, is shown in U.S. Pat. No. 3,379,326 issued to Anderson. With this closure, the post is initially formed as a part of one member and is retained atop a stopper by means of a separate, crimped band member. A one-piece cap device for a vial will be found in U.S. Pat. No. 4,863,049 and which includes a break-away top post to ready a stopper septum for use. In this case, the cap is of metal, thereby requiring crimping apparatus for its assembly and also presenting the possibility of exposed burrs or the like being formed when the top post is removed. The broad concept of providing a receptacle closure comprising a cap having an outer ring will be found in U.S. Pat. No. 4,236,646 issued to Ganz, Jr. et al. This device is not directed to a stopped closure and the outer ring is threadedly joined to the periphery of the cap to permit removal of the cap upon twisting of the outer ring. The above prior art is not seen to show or suggest the unique construction according to the present invention.

SUMMARY OF THE INVENTION

By the present invention, an improved closure assembly is provided comprising a cap member having a top post affixed to the balance of the cap in a frangible manner and which includes a depending slotted skirt portion presenting a plurality of outwardly flared segments each having an inturned lip. The same cap member is initially molded of plastics to include a sleeve element attached to the top of the skirt portion in a frangible manner. During the assembly of the closure assembly to a container, the cap member is lowered, with a stopper in place atop the rim of a vial. A circular ring projecting from beneath the top of the cap enters a circular recess in the top of the stopper and as further downward pressure is applied, the outer sleeve is severed from the balance of the cap member and is forced down over the skirt segments. This latter displacement forces the inturned lips on the skirt segments into a grasping position beneath the enlarged rim of the container whereupon the cap is secured to the container, with the stopper slightly compressed therebetween and leaving the top post ready for break-away at the time of intended use.

Accordingly, one of the objects of the present invention is to provide an improved closure assembly including a cap member having a depending annular ring engageable within a circular recess within a rubber stopper and with a skirt portion lockable beneath a vial rim by means of a slidable outer sleeve.

Another object of the present invention is to provide an improved closure assembly including an initially one-piece non-metallic cap member having an outer sleeve portion frangibly attached to a cup-shaped cap portion whereupon axial pressure upon the ring portion displaces it about the skirt of the cap portion to secure the assembly about the opening of a vial or the like.

A further object of the present ivention is to provide an improved closure assembly including a cap member having two break-away elements affixed to a cap portion with one said element being axially shiftable to secure the cap portion to a container opening with a stopper therebetween and the other said element subsequently removable to expose the center of the stopper for access by a syringe needle.

With these and other objects in view which will more readily appear as the nature of the invention is better understood, the invention consists in the novel combination and assembly of parts hereinafter more fully described, illustrated and claimed with reference being made to the attached drawings.

BRIEF DESCRIPTION OF THE DRAWINGS

FIG. 1 is an exploded top perspective view of the closure components of the present invention, prior to attachment to a receptacle top opening;

FIG. 2 is an enlarged side elevation, partly in section, of the components of FIG. 1 as initially applied to a receptacle;

FIG. 3 is a view similar to FIG. 2, illustrating the components during the final attachment operation; and FIG. 4 is a view similar to FIG. 3 and shows the closure fully assembled, with the top post in broken lines as it appears when a user readies the closure for access to the contents of the container.

Similar reference characters designate corresponding parts throughout the several figures of the drawings.

DESCRIPTION OF THE PREFERRED EMBODIMENT

Referring now to the drawings, particularly FIG. 1, the present invention will be understood to relate to a closure assembly generally designated 10 and which is intended to be attached to a vial, receptacle or the like 12 containing fluid, such as medicament. The closure assembly 10 includes an initially one-piece cap device 14, preferably of molded plastics composition. This construction most practically supports several features of the invention. First, it allows of ready mass manufacture and at the most minimal of cost. Secondly, it permits attainment and maintenance of a sterile closure which is of course critical in the case of closures associated with medications. Additionally, it readily allows of the formation of two break-away elements of the device with one of these elements displaceable to bias inherently resilient skirt segments about a receptacle rim and the other providing a top post removable at the time of usage.

During assembly of the cap device 14 to the rim 16 of a vial 12, a stopper 18 is disposed therebetween. This stopper 18 is of rubber or the like compressible material and includes a top wall 20 having a circular outer edge 22 defining a diameter no greater than that of the peripheral surface 24 of the vial rim. Depending from the top wall 20 of the stopper 18 is a circular flange 26 having an outer wall portion 28 with a diameter providing a close sliding fit within the inner surface 30 of the vial rim, as shown in FIGS. 2–4. To encourage a concentrated or localized seal with the vial inner surface 30, the stopper outer wall portion 28 includes a circular bead or ridge 29. Also, to facilitate the insertion of the stopper flange 26 into the neck opening 32 of the vial 12, the lower portion of the flange may be formed with an outer chamfer or bevel 34.

The above construction of the stopper 18 will be seen to provide a central, septum area 36 and an outer peripheral rim 38 with the latter having an undersurface 40 adapted to overlie the top surface 42 of the vial rim. The otherwise coplanar configuration of the stopper upper face 44 includes a substantially V-shaped annular groove 46 extending downwardly through the majority of the vertical thickness of the stopper top wall 20, the purpose of which will be understood hereinafter.

The cap device 14 comprises an initially integral or one-piece member which is molded to provide a generally cup-shaped cap 48 having a top wall 50 containing a central opening 52 bounded by the inner edge 54 of the surrounding top wall rim 55. From FIGS. 2–4 it will be seen that this opening 52 is immediately atop the stopper septum area 36 when the cap is assembled with a vial. A hollow frustoconical top post 56 projects upwardly from the cap top wall 50 and is molded such that its bottom edge 58 is integrally attached to the cap top wall in a manner defining a thin, frangible circular line of attachment 66.

Likewise, extending above the plane of the cap top wall is an outer circular ring or sleeve 60 which is of substantially constant cross-section, except for the area adjacent its lower edge 62. In this latter area, an inwardly directed locking ring 64 will be seen to form a reduced internal diameter formation upon the sleeve inner surface 65. In the as-manufactured or preassembly state as in FIG. 1, the lower edge 62 of the sleeve 60 is an integral part of the molded cap device 14, forming a thin juncture line all around the rim of the cap. At the juncture of the sleeve lower edge 62 and the locking ring 64, the thin frangible line of attachment 67 that joins the sleeve to the balance of the cap device 14 will be understood to remain intact, until the cap device is assembled to a vial.

Depending downwardly from the outer edge 51 of the cap top wall 50, is the cap skirt portion 68 which will be seen to comprise a plurality of skirt segments 70 separated by intermediate slots 72 which interrupt the bottom edge 74 of the segments. The outer face 76 of each of the segments 70 includes a horizontal recess 78, located just above the bottom edge 74. As will be appreciated hereinafter, the vertical extent of these recesses 78 mates with the vertical extent of locking ring 64 on the outer sleeve 60. Another feature to be noted with respect to the segment bottom edges 74 is that an inturned lip 80 projects radially inwardly of each segment.

A remaining structural feature of the cap device 14 comprises the annular ring 82 depending from the undersurface 84 of the cap top wall 50 and which is radially spaced intermediate the cap top wall outer periphery 51 and the inner edge 54. This ring is V-shaped or of triangular configuration and will be understood to define a cross-section slightly larger than that of the V-groove 46 provided in the stopper 18.

With the above closure assembly 10 in mind, the method of attachment of the components to a container such as the vial 12 may now be described. With the vial containing the prescribed fluid contents (not shown), the resilient stopper 18 is placed upon the vial rim 16 and seated as shown in FIG. 2 of the drawings. The cap device 14 is then lowered with its skirt portion 68 surrounding the stopper 18 and vial rim 16. This downward movement continues until the cap annular ring 82 is firmly seated within the stopper circular slot 46 as shown in FIG. 1. Thereafter, continued downward axial pressure upon the top edge 88 of the elevated outer sleeve 60 fractures the frangible line of attachment 67 and forces this sleeve toward the direction of its position as viewed in FIG. 3. As the internal diameter of the sleeve in the area of the locking ring 64 is comparable to the external diameter of the cap top wall outer periphery 51, it follows that as the sleeve 60 is broken away from its attachment, it is free to be displaced downwardly.

During the above downward displacement of the outer sleeve 60, its inwardly facing locking ring 64 bears against the outer face 76 of the plurality of outwardly flared skirt portion segments 70, progressively biasing them to a vertical alignment, parallel to the wall of the outer sleeve 60. This latter action will be seen to direct the cam surface of the inturned lip 80 of each skirt segment 70 into the undercut area as formed by the downwardly facing shoulder 90 of the vial rim 16, thereby effectively clamping the cap and intermediate stopper to the vial. At this point, the stopper rim 38 will be slightly compressed and the cap annular ring 82 tightly forced into the slightly undersized circular slot 46 of the stopper, thereby providing a complete air and fluid seal between the interior vial opening 32 and exteriorly of the vial. The final stage of the closure assembly is achieved as the outer sleeve 60 is further displaced from the position as in FIG. 3 to that of FIG. 4 whereupon the sleeve locking ring 64 snaps into the external recesses 78 of the plurality of cap skirt segments 70, thereby locking the assembly in the secured, ready to use condition.

The capped vial remains with its contents and the stopper septum area 36 in an aseptic condition until a user is ready for access to the medicament or the like therein. The firm clamping of the stopper rim undersurface 40 upon the top surface 42 of the vial rim seals against air or fluid migration between the interior neck opening 32 and the exterior while the annular ring 82 depending from the cap top wall 50 and firmly urged into the stopper groove 46 presents a labyrinth seal insuring similar protection to the top of the septum area 36. To initiate usage and permit access to the vial contents, one merely breaks off the top post 56 by applying finger pressure against one side thereof. This action readily fractures the frangible circular line of attachment 58 in the manner depicted by the broken line position 59 of the post in FIG. 4, and the post is discarded. Thereafter, the exposed stopper septum is accessible for insertion of a syringe needle, as needed.

From the above it will be appreciated that an improved closure assembly is provided wherein an integral plastics cap device containing two frangible elements is combined with a stopper to form a cap rigidly affixed to a vial rim. During mounting of the assembly, an outer sleeve is broken away from the cap and is axially shifted to displace the skirt portion of the cap into clamping engagement with the vial rim whereupon an annular ring on the cap is urged into a groove in the stopper to provide a labyrinth seal protecting the neck opening of the vial.

It is to be understood that the present invention is not limited to the sole embodiment described above, but encompasses any and all embodiments within the scope of the following claims.

We claim:

1. In a closure assembly for a vial having a rim surrounding a neck opening and with said rim including an outer peripheral surface provided with a lower shoulder, the improvement comprising;

said closure assembly including a cap device and a resilient stopper, said cap device including a cap including a top wall having an outer periphery, said cap device provided with a radially displaceable skirt portion depending from said top wall outer periphery, said skirt portion having inwardly directed locking means thereon, an outer sleeve having an inner surface juxtaposed said top wall outer periphery, said stopper including a top wall having a central septum area surrounded by a rim adapted to be disposed atop the vial rim, said cap top wall overlying said stopper rim with said skirt portion adapted to overlie the vial rim peripheral surface, said outer sleeve axially shiftable to overlie said skirt portion and radially inwardly biasing said skirt portion with said skirt portion locking means adapted to engage the vial rim shoulder to clampingly retain said stopper rim atop the vial rim.

2. A closure assembly according to claim 1 wherein, said cap top wall includes a central opening disposed atop said stopper septum area, a top post projecting upwardly from said cap top wall and overlying said cap top wall central opening, and said top post having a bottom edge integrally attached to said cap top wall by means of a frangible line whereby access to said stopper septum area is accomplished by breaking away said top post along said frangible line to expose said central opening in said cap top wall.

3. A closure assembly according to claim 1 wherein, said cap skirt portion includes a plurality of skirt segments separated by substantially vertical slots.

4. A closure assembly according to claim 1 wherein, said stopper includes a circular flange depending from said stopper top wall and disposed within said vial neck opening.

5. A closure assembly according to claim 1 including, an annular ring depending from said cap top wall, an upwardly facing circular slot within said stopper rim, and said annular ring disposed within said circular slot.

6. A closure assembly according to claim 1 wherein, said skirt portion includes an outer face having a recess, and said outer sleeve inner surface provided with a locking ring engageable within said skirt portion outer face recess to retain said skirt portion locking means engaged with said vial rim shoulder.

7. A closure assembly according to claim 1 wherein, said cap device is constructed of plastics composition.

8. A closure assembly according to claim 5 wherein, said cap annular ring defines a generally V-shaped configuration in cross-section.

9. A cap device for assembly, together with a resilient stopper, to the rim of a vial defining a neck opening, comprising;

an integral member including a cap having a top wall, said top wall provided with a central opening surrounded by a rim having an outer periphery, an outer sleeve having an inner surface provided with a lower edge, said outer sleeve affixed to said cap by means of a frangible line joining said sleeve lower edge to said cap outer periphery, a skirt portion depending from said cap outer periphery beneath said sleeve lower edge, said skirt portion including a plurality of skirt segments having lower ends flared outwardly from the vertical, said skirt segments including inwardly directed locking means on said lower ends, and a top post extending upwardly from and overlying said cap top wall opening, said top post affixed to said cap top wall by means of a frangible line.

10. A closure assembly according to claim 9 including, an annular ring projecting downwardly from said cap top wall rim.

11. A method of providing a closure assembly for a vial having a neck opening surrounding a rim provided with an outermost periphery having a bottom most shoulder, comprising;

forming a cap device comprising an integral member including a cap having a top wall including an outer periphery from which depends an outwardly flared skirt portion having locking means thereon, said integral member including an outer sleeve having an inner surface provided with a top edge and an opposite lower edge attached to said cap top wall outer periphery by means of a frangible line, selecting a resilient stopper having a central septum area surrounded by a rim having an outer edge, installing said stopper rim atop said vial rim, axially advancing said cap device toward said stopper with said skirt portion passing and overlying said stopper outer edge and vial rim peripheral surface, continuing said axially advancing step until said cap top wall abuts said stopper, applying axial pressure upon said outer sleeve top edge and rupturing said frangible line, continuing said step of applying axial pressure to downwardly displace said outer sleeve with said inner surface progressively shifting said outwardly flared skirt portion inwardly with said skirt portion locking means becoming engaged with said vial rim shoulder and retaining said resilient stopper compressibly captive between said cap top wall and vial rim.

* * * * *

US005085332A

REEXAMINATION CERTIFICATE (2262nd)

United States Patent [19]

Gettig et al.

[11] B1 5,085,332

[45] Certificate Issued Apr. 5, 1994

[54] CLOSURE ASSEMBLY

[75] Inventors: William A. Gettig; Larry E. Shook, both of Millheim, Pa.

[73] Assignee: Gettig Technologies Incorporated, Spring Mills, Pa.

Reexamination Request:
No. 90/002,946, Jan. 25, 1993

Reexamination Certificate for:

| | |
|---|---|
| Patent No.: | 5,085,332 |
| Issued: | Feb. 4, 1992 |
| Appl. No.: | 683,814 |
| Filed: | Apr. 11, 1991 |

[51] Int. Cl.[5] ..... B65D 41/62

[52] U.S. Cl. ..... 215/249; 215/274; 215/277

[58] Field of Search ..... 215/32, 249, 251, 253, 215/274, 277, DIG. 3; 220/270

[56] References Cited

U.S. PATENT DOCUMENTS 4,863,049 9/1989 Suzuki et al. ..... 215/249

FOREIGN PATENT DOCUMENTS 2854834 7/1980 Fed. Rep. of Germany .
3041972 5/1981 Fed. Rep. of Germany .
8805665 8/1988 Fed. Rep. of Germany .

*Primary Examiner*—Allan W. Shoap

[57] ABSTRACT

A closure for a vial or the like includes a cap clampingly engaging the rim of the vial with a resilient stopper therebetween. During the assembly of the closure, an initially one-piece cap device having an uppermost outer sleeve affixed to an integral cap provided with an outwardly flared skirt, is pressed downwardly toward the stopper disposed atop the vial rim. Continued pressure fractures the sleeve from the cap and urges the sleeve downwardly to bias the resilient skirt inwardly, causing lips thereon into a captive position beneath the vial rim. Continued downward movement of the sleeve results in a locking ring on the interior of the sleeve becoming a snap-fitted within a recess in the cap skirt. An aseptic condition of the vial contents is maintained as the stopper remains under vertical compression by the top wall of the cap and in view of an annular ring on the cap top wall which is urged into a circular slot provided in the rim of the stopper, overlying the vial rim. Access to the vial contents through the stopper septum is accomplished by breaking away a frangibly attached top post on the cap.

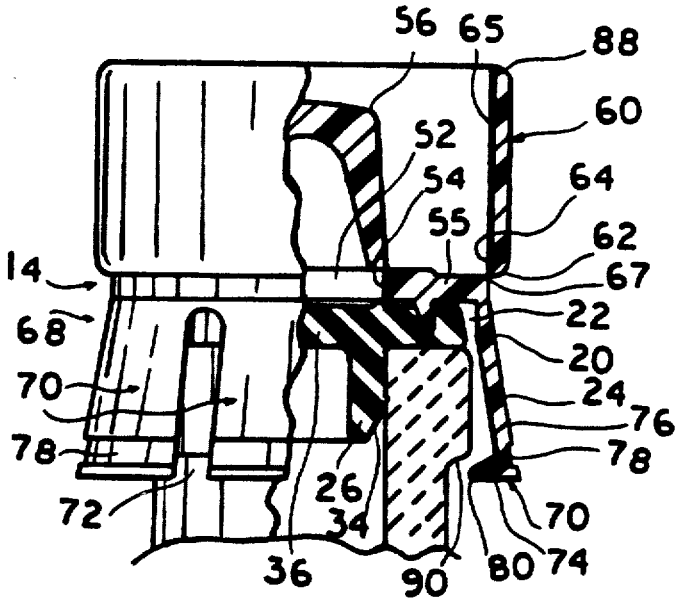

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 5, 8 and 10 is confirmed.

Claims 1–4, 6, 7, 9 and 11 are cancelled.

* * * * *